US006631710B2

(12) United States Patent
Schultheis

(10) Patent No.: US 6,631,710 B2
(45) Date of Patent: Oct. 14, 2003

(54) METHOD FOR COOKING AND CLEANING WITH TEMPERATURE-STABLE GLASS-CERAMIC COOKING VESSELS AND ACCESSORIES IN A PYROLYTICALLY SELF-CLEANING BAKING OVEN

(75) Inventor: Bernd Schultheis, Schwabenheim (DE)

(73) Assignee: Schott Glas, Mainz (DE)

( * ) Notice: Subject to any disclaimer, the term of this patent is extended or adjusted under 35 U.S.C. 154(b) by 28 days.

(21) Appl. No.: 09/922,193

(22) Filed: Aug. 3, 2001

(65) Prior Publication Data

US 2002/0005122 A1 Jan. 17, 2002

Related U.S. Application Data

(62) Division of application No. 09/564,759, filed on May 4, 2000, now abandoned.

(30) Foreign Application Priority Data

May 5, 1999 (DE) ..... 199 20 493

(51) Int. Cl.[7] ..... F24C 14/02
(52) U.S. Cl. ..... 126/19 R; 426/523
(58) Field of Search ..... 126/19 R, 21 R, 126/21 A, 273 R, 41 R; 219/400, 396, 398, 413; 426/520, 523, 521; 99/331, 324; 501/2, 4

(56) References Cited

U.S. PATENT DOCUMENTS 2,920,971 A * 1/1960 Stookey ..... 501/2
3,624,742 A * 11/1971 Hurko et al. ..... 126/21 R
3,669,090 A * 6/1972 Jung et al. ..... 126/21 A
3,816,704 A * 6/1974 Borom et al. ..... 219/465.1
4,009,795 A * 3/1977 Hurko et al. ..... 220/62.17
4,493,976 A * 1/1985 Wilson ..... 126/21 R
4,507,392 A * 3/1985 Rittler ..... 501/4

FOREIGN PATENT DOCUMENTS

EP 0 289 167 A1 - A1 * 11/1988
JP 4-227424 - A * 8/1992
WO WO 99/02463 - A1 * 1/1999

* cited by examiner

*Primary Examiner*—Henry Bennett
*Assistant Examiner*—Josiah C. Cocks
(74) *Attorney, Agent, or Firm*—Michael J. Striker

(57) ABSTRACT

The method of cooking in and subsequently cleaning a pyrolytically self-cleaning baking oven includes providing a glass-ceramic baking oven accessory and glass-ceramic cooking vessel for cooking in the self-cleaning baking oven, which have as small as possible a linear thermal expansion coefficient and sufficient temperature stability to remain without damage in the self-cleaning baking oven during pyrolytic self-cleaning of the self-cleaning oven. The glass-ceramic material of the baking oven accessory and cooking vessel has a linear thermal expansion coefficient of less than or equal to $3\times10^{-6}$/k and a specific thermal stress of less than 0.25 or 0.23 MPa/K with a temperature stability of greater than 500° C. or 550° C. Then after cooking and during self-cleaning of the baking oven the baking oven accessory and the baking oven cooking vessel are placed within the self-cleaning baking oven for cleaning so that a separate manual cleaning is unnecessary.

6 Claims, 1 Drawing Sheet

METHOD FOR COOKING AND CLEANING WITH TEMPERATURE-STABLE GLASS-CERAMIC COOKING VESSELS AND ACCESSORIES IN A PYROLYTICALLY SELF-CLEANING BAKING OVEN

CROSS-REFERENCE

This is a divisional of U S. patent application, Ser. No. 09/564,759, filed May 4, 2000 now abandoned.

BACKGROUND OF THE INVENTION

1. Field of the Invention

The present invention relates to an accessory or fitting for a baking oven and a cooking vessel or dish for it. This sort of accessory or fitting typically can be a broiler grid, a fat collecting dish, a baking pan or a cooking or baking dish. Typically the vessel or dish can be a riser mold, a roasting vessel, a pot or the like. The present invention also relates to methods of cooking in a pyrolytically self-cleaning baking oven with a baking oven accessory and a baking oven cooking vessel and of cleaning both the oven accessory and cooking vessel as well as the baking oven.

2. Prior Art

Pyrolysis self-cleaning of baking ovens is currently widespread. Overflowing and burned-on food residues are turned to ash by pyrolysis at temperatures of typically 500° C. and can subsequently be wiped out with a moist towel or rag. Currently accessories for baking ovens and cooking vessels for them, which are made from aluminum sheet, enameled steel sheet or chromium grid rods in grids, must be removed from baking ovens during the pyrolysis self-cleaning of the baking ovens, since the pyrolysis temperature would make the accessories and the cooking vessels unuseable because of strong warping and/or oxidation. Glass baking dishes may be used only up to a maximum temperature of 250° C.

Because of this aspect of the currently used baking oven accessories and vessels or dishes for them burned-on food residues on the baking oven accessories or the cooking vessels or dishes must be removed from them by hand during a separate cleaning operation. Besides the considerable time consumed and the not inconsiderable water consumption occurring in this separate cleaning process often strong abrasive means or a scrubbing sponge or steel wool must be used. As a result scratches are produced on the metal accessories or vessels, which promote burning on, for example in baking vessels in the next baking process.

Especially in commercial applications outside of private applications, e.g. in bakeries, pizza baking concerns, restaurants, etc., these special cleaning efforts for baking oven accessories and vessels are a considerable disadvantage.

SUMMARY OF THE INVENTION

It is an object of the present invention to provide an improved method of cooking with a self-cleaning baking oven with an oven accessory and cooking vessel and of cleaning the oven accessory and cooking vessel as well as the baking oven, in which the oven accessory and cooking vessel are made from materials that prevent damage to the oven accessory and cooking vessel when they are placed in the baking oven during pyrolysis self-cleaning in order to eliminate the required separate cleaning processes for the self-cleaning baking oven and the oven accessory and cooking vessel.

According to the invention the method for cooking in and subsequent cleaning of a pyrolytically self-cleaning baking oven and of baking oven accessories and of baking oven cooking vessels used in cooking in the baking oven, comprises the steps of:

a) providing a baking oven accessory and a baking oven cooking vessel for cooking in the self-cleaning baking oven, said baking oven accessory and baking oven cooking vessel consisting of respective materials having as small as possible a coefficient of linear thermal expansion and sufficient temperature stability to remain without damage in the self-cleaning oven during pyrolytic self-cleaning of the self-cleaning oven;

b) cooking in the self-cleaning oven with the baking oven accessory and the baking oven cooking vessel provided in step a); and c) pyrolytically self-cleaning the self-cleaning baking oven with the baking oven accessory and the baking oven cooking vessel within the self-cleaning baking oven during the self-cleaning in order to clean the baking oven accessory and baking oven cooking vessel as well as the self-cleaning baking oven;

whereby a separate manual cleaning of the baking oven accessory and the baking oven cooking vessel is eliminated.

According to the invention, the accessory for a baking oven and the cooking vessel or dish placed on it or for it are made from a material that has a sufficiently high temperature stability at the high pyrolysis temperatures occurring during pyrolysis self-cleaning in baking ovens, e.g. at a pyrolysis temperature of about 500° C., so that the cooking vessels or dishes and the accessories can be left in the baking oven during the pyrolysis self-cleaning, and that has as small as possible a thermal linear expansion coefficient.

The baking oven accessories and cooking vessels or dishes used on them according to the invention have the advantage that they can remain in the oven during pyrolysis self-cleaning of the baking oven so that they are cleaned at the same time as the oven. A troublesome manual cleaning of the cooking residue from the accessories and vessels or dishes is thus eliminated.

The so-called baking oven accessories and cooking vessels or dishes can be used in baking ovens in private households and in commercial establishments. They can be advantageously used as tempering ovens in scientific and engineering laboratories.

According to a preferred embodiment of the invention the accessories for the baking oven and the cooking vessels or dishes for it are made from glass, glass-ceramic or ceramic material with a thermal linear expansion coefficient less than or equal to $3\times10^{-6}$/K.

The glass-ceramic material used for the accessories and vessels or dishes should have a specific thermal stress of <0.25 MPa/K with a temperature stability >500° C. or of <0.23 MPa/K with a temperature stability of >550° C.

The baking dishes and baking pans are preferably formed from the foregoing type of materials.

According to a further aspect of the invention the material for the accessories and vessels or dishes for the baking oven can be a superior quartz-mixed-crystal glass-ceramic material, which can be transparent or colored, preferably dark. According to another aspect the material can be a keatite-mixed-crystal glass-ceramic material, which can be opaque, white or colored.

The high radiation permeability from above during pyrolysis heating is the essential advantage obtained by using glass-ceramic material.

According to another preferred embodiment the accessories for the baking oven can be made from a ceramic material with comparatively little surface porosity, preferably as little surface porosity as possible. This ceramic material is preferably aluminum oxide. Thus a broiler grid can be made from ceramic rods or tubes as well as dishes and pans.

According to a third preferred embodiment of the invention the accessories for the baking oven and the cooking vessels or dishes placed on them are made from a high temperature-stable metallic alloy with reduced linear thermal expansion coefficient. This metallic alloy can be a chromium-nickel alloy or an iron-nickel alloy, especially an alloy that is marketed under the tradename INVAR. This metallic material is especially suitable for broiler grids.

BRIEF DESCRIPTION OF THE DRAWINGS

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
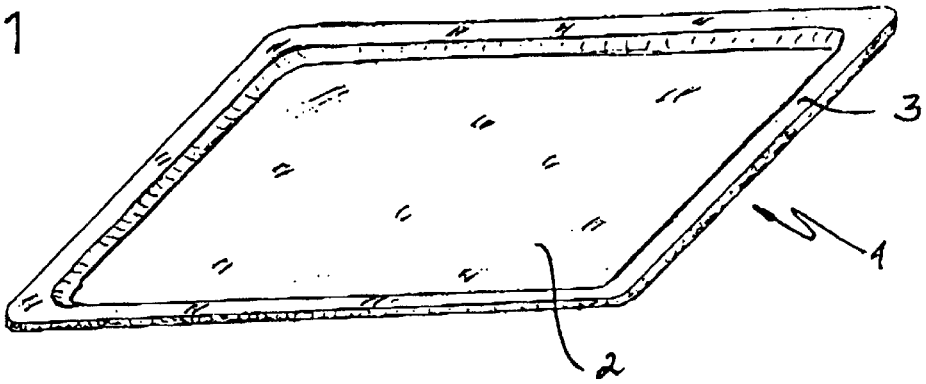
FIG. 1 is a top perspective view of a baking dish made from a material according to the invention.

FIG. 1 is a perspective view of a baking dish 1, as it is used especially for baking cakes or the like. The baking dish t has a flat bottom portion 2 and raised peripheral edge portion 3, which has a flattened top surface. The material of the baking dish preferably is a transparent superior quartz-mixed-crystal glass-ceramic material, which is marketed under the trademark ROBAX©, or alternatively a dark colored superior quartz-mixed-crystal glass-ceramic material similar to glass-ceramic material that is marketed under the trademark CERAN©.

The baking dish 1 can be made from white opaque keatite-mixed-crystal glass-ceramic material, for example that known under the trademark CERAX®, or alternatively from colored opaque keatite-mixed-crystal glass-ceramic material.

This glass-ceramic material has a specific thermal stress of <0.23 MPa/K with a temperature stability of >550° C.

Figure 2:
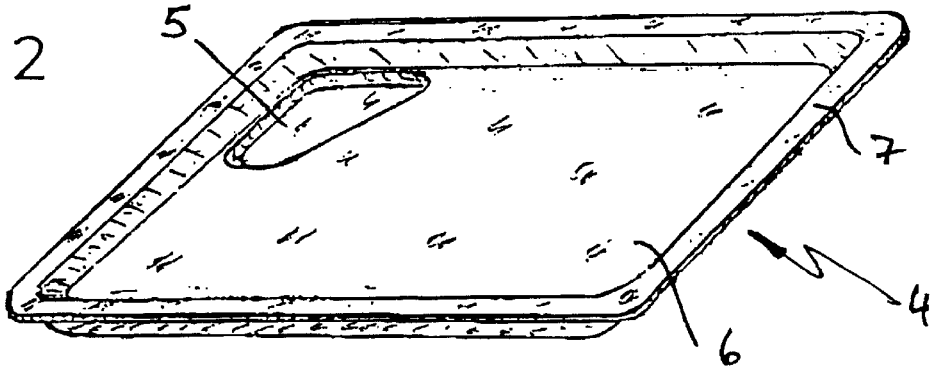
FIG. 2 is top perspective view of a baking pan with an additional partially sunken fat/baking juice collecting region.

FIG. 2 is a baking pan 4 with an additional fat/baking juice collection region 5 partially sunken in the flat bottom portion 6. This baking pan 4, like the baking dish 1 according to FIG. 1, has a raised peripheral edge portion 7, which is generally more curved than in the case of the baking dish shown in FIG. 1.

The baking pan 4 shown in FIG. 2 is made preferably from a glass-ceramic material, as described in connection with FIG. 1.

Alternatively to the glass-ceramic material described in connection with FIG. 1, both the baking dish 1 and the baking pan 4 can be made from a ceramic material, for example aluminum oxide with little surface porosity.

Basically it can also comprise a high temperature-stable metallic material with a reduced linear thermal expansion coefficient.

Figure 3:
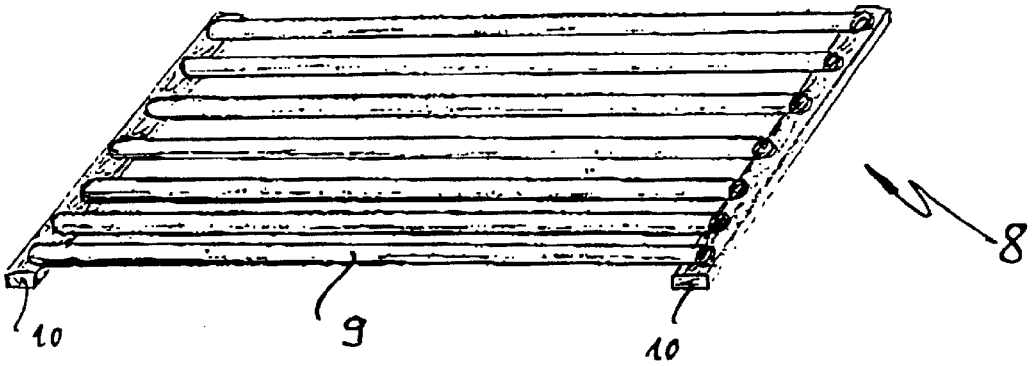
FIG. 3 is a top perspective view of a broiler grid comprising rods or tubes made from the materials of the invention.

FIG. 3 shows a broiler grid 8 with rods or tubes 9, which are attached to two frame members 10. These rods or tubes 9 and the frame members 10 are made from a ceramic material with a reduced surface porosity or from a chromium-nickel or iron-nickel alloy with reduced or slight linear thermal expansion properties.

Other accessories for baking ovens and cooking vessels or dishes can be made in the same manner as the embodiments described above.

The term "comparatively little" surface porosity means that the material is first selected according to the principal criteria, namely the thermal expansion coefficient and high temperature stability criteria, and then according to its surface porosity so that the material with the smallest surface porosity is selected while satisfying the principal criteria.

The disclosure in German Patent Application 199 20 493.4-16 of May 5, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an accessory or fitting for a baking oven and a cooking vessel or dish useable on it, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A method of cooking in a pyrolytically self-cleaning baking oven and of subsequent cleaning of the pyrolytically self-cleaning baking oven and of baking oven accessories and baking oven cooking vessels used during cooking in the self-cleaning baking oven, said method comprising the steps of:

a) providing a baking oven accessory and a baking oven cooking vessel for cooking in the self-cleaning baking oven, said baking oven accessory and said baking oven cooking vessel both consisting of glass-ceramic material having as little surface porosity as possible, a thermal expansion coefficient of less than or equal to $3\times10^{-6}$/K, a specific thermal stress of less than 0.25 MPa/K with a temperature stability of greater than 500° C. or of a specific thermal stress of less than 0.23 MPa/K with a temperature stability of greater than 550° C.;

b) cooking in said self-cleaning oven with said baking oven accessory and said baking oven cooking vessel provided in step a); and c) pyrolytically self-cleaning said self-cleaning baking oven with said baking oven accessory and said baking oven cooking vessel within said self-cleaning baking oven during said self-cleaning so as to self-clean said baking oven accessory and said baking oven cooking vessel;

whereby separate manual cleaning of said baking oven accessory and said baking oven cooking vessel is unnecessary.

2. The method as defined in claim 1, wherein said glass-ceramic material consists of high quartz mixed crystal glass-ceramic or keatite mixed crystal glass-ceramic.

3. The method as defined in claim 1, wherein said glass-ceramic material is transparent or colored.

4. The method according to claim 1, wherein said glass-ceramic material is white opaque or colored opaque.

5. The method as defined in claim 1, wherein said baking oven accessory comprises a broiler grid (8) made from rods or tubes (9).

6. The method according to claim 1, wherein said baking oven cooking vessel comprises a baking dish or a baking pan.

* * * * *